US006756996B2

(12) United States Patent
Lippincott

(10) Patent No.: US 6,756,996 B2
(45) Date of Patent: Jun. 29, 2004

(54) OBTAINING A HIGH REFRESH RATE DISPLAY USING A LOW BANDWIDTH DIGITAL INTERFACE

(75) Inventor: Louis A. Lippincott, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 455 days.

(21) Appl. No.: 09/741,566

(22) Filed: Dec. 19, 2000

(65) Prior Publication Data

US 2002/0075226 A1 Jun. 20, 2002

(51) Int. Cl.[7] ..... G09G 5/02
(52) U.S. Cl. ..... 345/698; 348/439.1
(58) Field of Search ..... 345/698, 103, 345/204, 208, 213; 348/439.1

(56) References Cited

U.S. PATENT DOCUMENTS 4,010,466 A * 3/1977 Hofstein ..... 342/185
5,600,376 A * 2/1997 Casavant et al. ..... 348/423.1
5,923,385 A * 7/1999 Mills et al. ..... 348/715
6,118,491 A * 9/2000 Wu et al. ..... 348/526
6,166,772 A * 12/2000 Voltz et al. ..... 348/448
6,304,297 B1 * 10/2001 Swan ..... 348/556

OTHER PUBLICATIONS

"Digital Visual Interface", Revision 1.0, Digital Display Working Group, Apr., 1999, pp. 6–8.

* cited by examiner

*Primary Examiner*—Kent Chang
(74) *Attorney, Agent, or Firm*—Blakely, Sokoloff, Taylor & Zafman LLP

(57) ABSTRACT

A sequence of input groups, each input group containing a number of input pixels, is received. A sequence of output frames is provided, where each output frame contains a number of output pixels to refresh a display screen. The pixels of each output frame include (1) a number of new pixels which are the input pixels of a respective input group, and (2) a number of old pixels which are the input pixels of a previous input group. The previous input group is one that's received previous to the respective input group.

21 Claims, 3 Drawing Sheets

108_3

| | | | | | | |
|---|---|---|---|---|---|---|
| 1 OLD | 2 NEW | 3 OLD | 4 NEW | 5 OLD | 6 NEW | |
| 1 NEW | 2 OLD | 3 NEW | 4 OLD | 5 NEW | 7 OLD | |
| | | | | | | |
| | | | | | | |
| | | | | | | |
| | | | | | | |
| | | | | | | |

FIG. 2

108_4

| | | | | | | |
|---|---|---|---|---|---|---|
| 1 NEW | 2 OLD | 3 NEW | 4 OLD | 5 NEW | 6 OLD | |
| 1 OLD | 2 NEW | 3 OLD | 4 NEW | 5 OLD | 6 NEW | |
| | | | | | | |
| | | | | | | |
| | | | | | | |
| | | | | | | |
| | | | | | | |

FIG. 3

OBTAINING A HIGH REFRESH RATE DISPLAY USING A LOW BANDWIDTH DIGITAL INTERFACE

BACKGROUND

This invention relates to digital techniques used in providing pixels for refreshing a display screen.

A still picture on a television or computer monitor's display screen appears, through human eyes, to be fixed in color and location. However, due to technical requirements of the display screen, the picture must be repeatedly redrawn or "refreshed" several tens of times each second so as to prevent the picture from being distorted. The higher the refresh rate, the more pleasing and accurate the picture appears and the less strain its viewing presents to the eyes, particularly when displaying motion pictures, i.e. video. For instance, if video is being displayed at 24 frames or pictures per second, a refresh rate of 100 Hz may be acceptable.

A computer monitor receives display information, including the picture elements or "pixels" that define each frame of video to be displayed, from a computer system video adapter. Digital computer monitors, as contrasted with analog monitors, have a digital interface to the video adapter. That is, the input signal which contains the pixels received from the video adapter is digital rather than analog. There are certain advantages to such a scheme, including the use of a general purpose digital peripheral bus rather than a dedicated analog link.

A serious bandwidth problem arises, however, when attempting to provide high refresh rates in digital monitors that also have high resolution. For instance, a 100 Hz monitor allowing a high resolution of 1280×1024 pixels in each frame must be continuously provided with 1280*1024*100~131 million pixels per second. With each pixel being, for instance, three bytes long, this translates to an unacceptably high data transfer rate from the video adapter to the digital monitor of approximately 400 megabytes per second.

BRIEF DESCRIPTION OF THE DRAWINGS

The invention is illustrated by way of example and not by way of limitation in the figures of the accompanying drawings in which like references indicate similar elements. It should be noted that references to "an" embodiment in this disclosure are not necessarily to the same embodiment, and they mean at least one.

FIGS. 2 and 3 show two successive output frames according to an embodiment of the invention.

DETAILED DESCRIPTION

Figure 1:
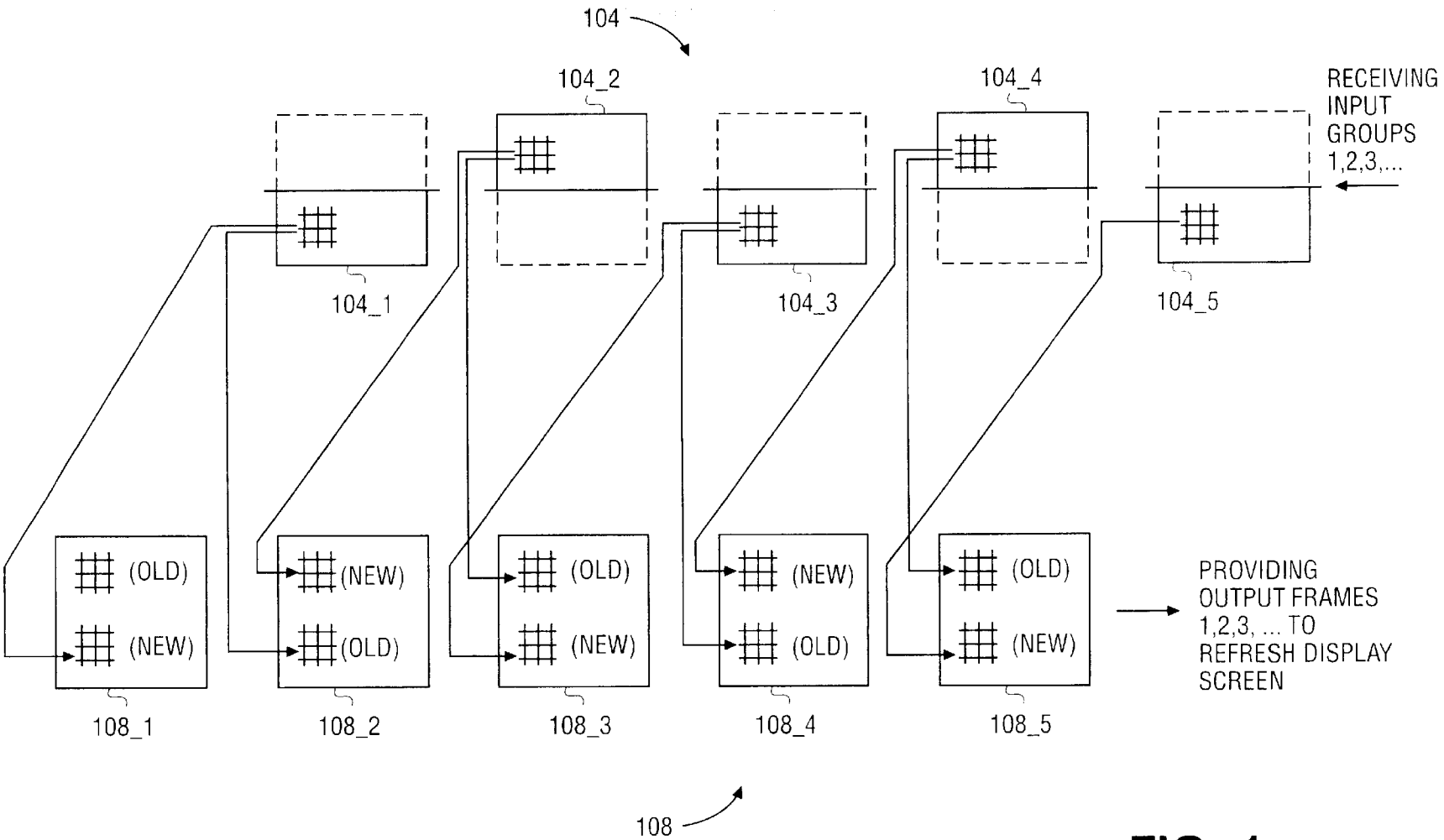
FIG. 1 illustrates a method for receiving input groups and providing output frames according to an embodiment of the invention.

According to an embodiment of the invention, a method for obtaining a high refresh rate on a display screen is disclosed that uses a relatively low bandwidth digital interface. FIG. 1 illustrates a method for receiving input pixel groups and providing output frames according to an embodiment of the invention. A sequence of input groups 104 are received, where each input group contains a number of input pixels. In the example shown in FIG. 1, five input groups are shown and are referenced 104_1, 104_2, . . . 104_5. The method provides a sequence of output frames 108 in response to these input groups as shown. In this example, there are five output frames referenced 108_1, 108_2, . . . 108_5. Each output frame contains a number of output pixels to refresh a display screen (not shown). In a particular embodiment, the input groups are received in order 1, 2, . . . and the output frames are provided also in order 1, 2, . . . Thus, although output frame 108_2 is shown as being to the right of output frame 108_1, the former frame is actually provided later in time than the latter one.

The construction of the sequence of output frames 108 is such that each output frame includes (1) a number of new pixels which are the input pixels of a respective input group, and (2) a number of old pixels which are the input pixels of a previous input group. The previous input group is an input group that's received previous to the respective input group. For instance, the output frame 108_2 includes a number of new pixels which are the input pixels of the input group 104_2, where the latter is defined as being the respective input group of the output frame 108_2. In addition, this output frame includes a number of old pixels which are the input pixels of input group 104_1. Similarly, output frame 108_3 includes new pixels which are the pixels in input group 104_3 and old pixels which are the pixels in input group 104_2. Thus, it can be seen that the pixels in each output frame are obtained from two different input groups. In the exemplary embodiment shown in FIG. 1, the previous input group is that which is received immediately prior to receiving the respective input group. In other words, there are no intervening pixel groups in such an embodiment between input groups 104_2 and 104_3, 104_3 and 104_4, etc. However, as an alternative, the method may allow intermediate input groups to be present, between the respective input group and its previous input group, from which the pixels are taken to fill an output frame.

In a particular embodiment of the invention, the pixels in each output frame essentially consist of the new and old pixels. In a further embodiment, each input group has essentially one-half the number of pixels as an output frame. Thus, the old pixels and the new pixels in an output frame are essentially of the same number. This embodiment is illustrated in FIG. 1 by the use of the dotted lines connected with each input group to illustrate that the pixels in the input group are essentially one-half the number of pixels as an output frame. An advantageous effect of such an embodiment may be appreciated by considering the following example. Assume the display screen is to be refreshed at 100 Hz. This would require that 100 output frames per second be provided to refresh the display screen. If each frame were to have X number of bits for defining the pixels in the frame, then 100X bits per second would be needed to provide the output frames. Using a conventional method in which the pixels of each output frame correspond to those of a respective input frame, a bandwidth of 100X bits per second would also be needed to receive the input frames. With an embodiment of the invention as shown in FIG. 1, however, only one-half of a conventional input frame is needed at a given time to create an output frame, because the other half of the output frame is created using a previously received and stored input group. This means that a bandwidth of 50X bits per second are needed to receive the input groups in FIG. 1, yet still allowing output frames to be provided at 100X bits per second. Thus, there is a 50% reduction in the bandwidth of the digital interface that was conventionally used for receiving the input frames.

Such a reduction in the bandwidth of the digital interface should not adversely affect the quality of the image being displayed, even though only one-half of the pixels in each output frame are from the most recent group, because the rate at which pixel information is changed on a display screen is typically considerably less than the refresh rate. Thus, even when the pixel information is changing at a relatively high frame rate of 24 frames per second (standard video), the refresh rate of 100 Hz is almost four times faster so that if a pair of consecutive input groups defines an input frame, at least two unchanged input frames may be displayed before the pixel information starts to change.

Although FIG. 1 illustrates the old and new pixels as being grouped into separate and alternating upper and lower parts of each output frame, a better alternative, from the standpoint of image quality, may be to mix distribution of new and old pixels more evenly across each entire output frame. For instance, in FIG. 2, an exemplary output frame 108_3 is shown in which the old and new pixels are distributed in a checkerboard pattern. Since each pixel location will alternately have new and old pixels, from one output frame to the next, FIG. 3 illustrates a subsequent output frame 108_4 in which pixel locations having old pixels in the previous output frame 108_3 now have new pixels. In such an embodiment, if the pixels in each row of a frame were numbered 1, 2, 3, . . . , one-half of the odd numbered pixels in each output frame are old pixels and one-half are new pixels. This may be achieved by sending odd pixels on odd numbered lines and even pixels on even numbered lines of a frame for one input group, and even pixels on odd lines and odd pixels on even lines of the same frame for the next input group. This scheme also helps eliminate vertical stripes that may appear in the image being displayed if all odd pixels were new and all even pixels were old on any given output frame to refresh the display screen. Other schemes for mixing the distribution of old and new pixels may alternatively be used.

The above-described embodiments of the method for refreshing a display screen, including the receiving and providing operations, may be performed in an otherwise conventional display monitor. In such an embodiment, the sequence of input groups will be received through a digital monitor interface of the display monitor. In a further embodiment of the invention, the display monitor may include a cathode ray tube (CRT) such that the sequence of output frames are converted into analog form to drive one or more guns of the CRT. As an alternative to the CRT, other types of display screens including liquid crystal display (LCD) may be used.

Yet another embodiment of the invention may be to provide the capability for receiving the input groups and providing the output frames in an integrated graphics component or graphics chip of a chipset. The chipset may be a group of chips that allow a processor to communicate with the rest of the computer system. The graphics chip or graphics component would control the images that are being displayed, to lighten the processing load on the processor. In such an embodiment, the sequence of input groups would be received through a main memory interface of the chipset.

Figure 4:
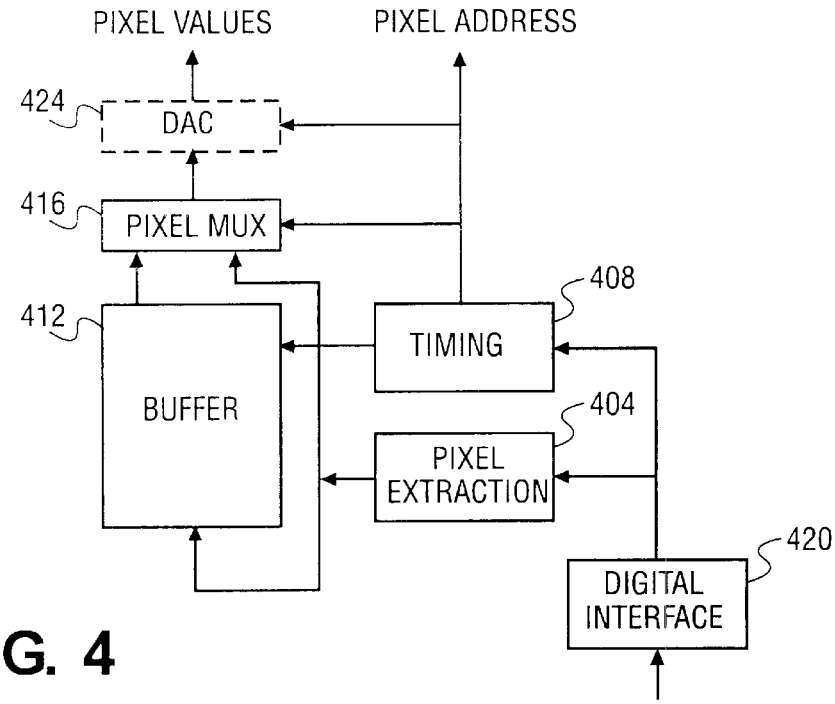
FIG. 4 depicts a block diagram of a refresh circuit according to an embodiment of the invention.

FIG. 4 depicts a block diagram of a refresh circuit according to an embodiment of the invention. A digital interface 420 is to provide a digital sequence which includes a sequence of input groups. A pixel extraction circuit 404 is coupled to extract a number of input pixels for each input group in the sequence of input groups. These extracted pixels are fed simultaneously to a buffer 412 as well as one input of a pixel multiplexer 416. A second input of the pixel multiplexer 416 is coupled to an output of the buffer 412. The output of the pixel multiplexer 416 is to provide a sequence of output frames, where each output frame contains a number of output pixels taken from the first and second inputs in accordance with a clock timing determined by a timing circuit 408. This is the clock timing for activating elements of a display screen (not shown) to display the input pixels. Information for the clock timing may be provided through the digital interface 420. This clock timing that has been determined by the timing circuit 408 may also be viewed as a sequence of pixel addresses, such that each pixel that is provided at the output of the pixel multiplexer 416 has a respective pixel address provided by the timing circuit 408.

The output frames provided at the output of the pixel multiplexer 416 are created so that the pixels of each output frame include (1) a number of new pixels, received at the first input of pixel multiplexer 416, which are the input pixels of a respective input group, and (2) a number of old pixels, received at the second input of the multiplexer 416, where these are the input pixels of a previous input group. Note that the previous input group is an input group that's received in this embodiment by the pixel extraction circuit 404, previous to the respective input group and has been temporarily stored in the buffer 412. Operation of the circuit in FIG. 4 may be explained using the exemplary flow of pixels into and out of the multiplexer 416 as shown in FIG. 5.

Figure 5:
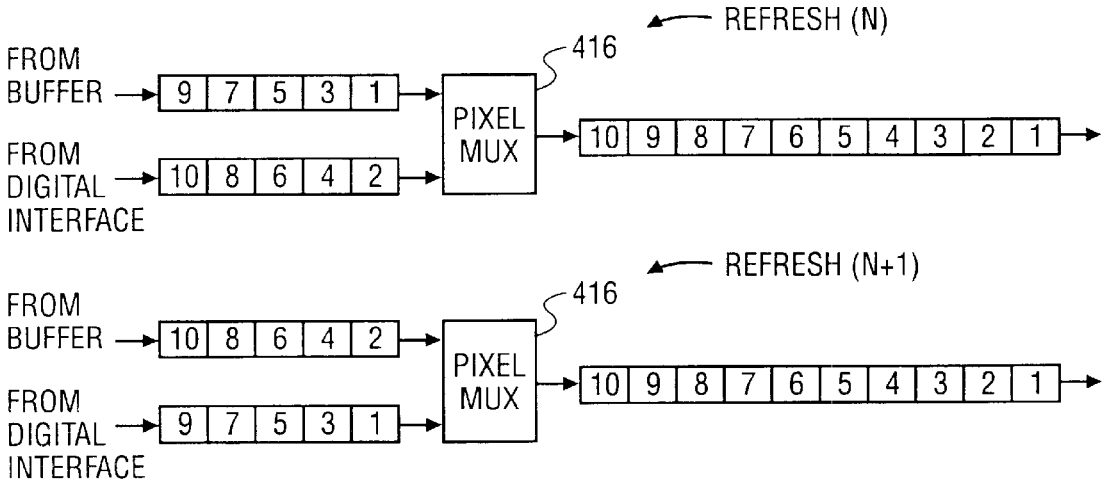
FIG. 5 illustrates the flow of pixels into and out of the multiplexer of the refresh circuit, according to an embodiment of the invention.

FIG. 5 illustrates two refresh operations (n) and (n+1) where the latter refresh operation occurs immediately after the former refresh operation. This corresponds to the situation where the logic in the pixel extraction circuit 404 and the timing circuit 408 is designed to detect the previous input group as being the one that is received immediately prior to receiving the respective input group. To simplify operation, the buffer 412 in this embodiment has a first-in-first-out structure (FIFO) to store and then deliver the input pixels to the multiplexer 416 in an orderly manner and according to a clock timing provided by the timing circuit 408. Referring now to FIG. 5 again, in refresh (n), odd-numbered pixels 1, 3, 5, . . . had been stored in the buffer 412 and are accordingly provided in that sequence to an input of the multiplexer 416. At essentially the same rate as the odd pixels, pixels numbered 2, 4, 6, . . . are delivered to another input of the multiplexer 416 from the digital interface 420. As an example, the combining of the odd numbered and even numbered pixels by the pixel multiplexer 416 results in an entire row of pixels 1, 2, 3, . . . of an output frame being sent to refresh the display screen. This combination of taking the odd numbered pixels (which, in refresh (n), are old pixels) from the buffer and taking the even numbered pixels (which are new pixels) from the digital interface may be repeated to form each entire row of an output frame, in refresh (n). To prepare for the next refresh (n+1), the even numbered pixels, in refresh (n), that are being fed to the multiplexer 416 are also written to the buffer 412. In this way, these same even numbered pixels become "old pixels" that are provided by the buffer to form the successive output frame, in refresh (n+1). In this latter refresh operation, the odd number pixels that are needed to complete the output frame are obtained this time from a new input group, via the digital interface 420.

In general, one of ordinary skill in the art will recognize that the method described above in connection with FIG. 1 and its variations may be implemented by the circuit of FIG. 4. For instance, the timing circuit 408 may be designed to define the pixels of each output frame as essentially consisting of the old and new pixels, the old pixels being provided by the buffer 412 and the new pixels being obtained directly from the pixel extraction circuit 404. The logic circuitry in the pixel extraction circuit 404 may be further designed to define each output frame so that if the pixels in each row of a frame were numbered 1, 2, 3, . . . , one-half of the odd numbered pixels in each output frame are old pixels and one-half are new pixels. To help minimize the bandwidth needed for refresh at the digital interface 420, the pixel extraction circuit 404 and the timing circuit 408 may be further designed to detect that each input group has essentially one-half the number of pixels as an output frame.

The digital interface 420 may take on different forms according to the embodiment desired. For instance, the interface 420 may be that of a digital monitor and may be configured according to the Digital Visual Interface (DVI) as defined by the Digital Display Working Group (DDWG) which is an open industry group whose objective is to address requirements for a digital connectivity specification for high performance personal computers and digital displays. See Digital Visual Interface, Revision 1.0, Apr. 2, 1999, published by the DDWG.

In a further embodiment of the refresh circuit shown in FIG. 4, a digital to analog converter 424 is coupled to the output of the pixel multiplexer 416 to convert the sequence of output frames into analog form. This analog form, which may essentially be viewed as pixel values, may be analog red, green and blue (RGB) signals for use by CRT electron guns (not shown). In such an embodiment, the pixel addresses provided by the timing circuit 408 would correspond to CRT deflection signals, which may be based upon sync timing for a CRT display, that has been extracted by the timing circuit 408.

In yet a further embodiment of the invention, the digital interface 420 of the refresh circuit in FIG. 4 may be a main memory interface of a chipset that provides the core functionality of a motherboard in a computer.

To summarize, various embodiments of the invention directed to a method and apparatus that enables a high refresh rate using a low bandwidth digital interface have been described. High resolution and high refresh rate display screens may be supported using such embodiments with the advantageously lower bandwidth interface. In the foregoing specification, the invention has been described with reference to specific exemplary embodiments thereof. It will, however, be evident that various modifications and changes may be made thereto without departing from the broader spirit and scope of the invention as set forth in the appended claims. For instance, the invention is applicable not only in a digital monitor but also in a chipset, such as one suitable for a Unified Memory Architecture (UMA) in which the digital interface is to a main memory that contains essentially all data in the system including video and application data. The specification and drawings are, accordingly, to be regarded in an illustrative rather than a restrictive sense.

What is claimed is:

1. A method comprising:

receiving a sequence of input groups, each input group containing a plurality of input pixels; and providing a sequence of output frames, each output frame containing a plurality of output pixels to refresh a display screen, wherein the pixels of each output frame include (1) a plurality of new pixels which are the input pixels of a respective input group, and (2) a plurality of old pixels which are the input pixels of a previous input group, the previous input group being an input group that is received previous to the respective input group, wherein the receiving and providing are performed in a display monitor, the sequence of input groups being received through a digital monitor interface of the display monitor.

2. The method of claim 1 wherein the previous input group is the input group that is received immediately prior to receiving the respective input group.

3. The method of claim 1 wherein the pixels of each output frame essentially consist of the plurality of new and old pixels.

4. The method of claim 3 wherein each input group has essentially one-half the number of pixels as an output frame.

5. The method of claim 4 wherein the sequence of input groups is received at a rate that is sufficiently high so as to allow the display screen to be refreshed at over 100 Hz.

6. The method of claim 3 wherein, if the pixels in each row of a frame were numbered 1,2,3, . . . , one half of the odd numbered pixels in each output frame are old pixels and one half are new pixels.

7. The method of claim 1 further comprising:

converting the sequence of output frames into analog form to drive one or more guns of a cathode ray tube (CRT) in the display monitor.

8. An article of manufacture comprising:

a digital monitor interface of a display monitor, to provide a digital sequence which includes a sequence of input groups;

a pixel extraction circuit coupled to the digital interface to extract a plurality of input pixels for each input group in the sequence of input groups;

a timing circuit coupled to the digital interface to determine a clock timing for activating elements of a display screen to display the input pixels;

a buffer coupled to the pixel extraction circuit, to store the plurality of input pixels for each input group in the sequence; and a pixel multiplexer having a first input coupled to the pixel extraction circuit, a second input coupled to the buffer, and an output to provide a sequence of output frames, each output frame containing a plurality of output pixels taken from the first and second inputs as determined by the timing circuit, so that the pixels of each output frame include (1) a plurality of new pixels, received at the first input, which are the input pixels of a respective input group, and (2) a plurality of old pixels, received at the second input, which are the input pixels of a previous input group, the previous input group being an input group that is received, by the pixel extraction circuit, previous to the respective input group.

9. The article of manufacture of claim 8 wherein the buffer has a first-in-first-out structure to store and then deliver the input pixels.

10. The article of manufacture of claim 8 wherein the pixel extraction circuit and the timing circuit are to detect the previous input group as being the input group that is received immediately prior to receiving the respective input group.

11. The article of manufacture of claim 8 wherein the timing circuit is to define the pixels of each output frame as essentially consisting of the plurality of new and old pixels.

12. The article of manufacture of claim 11 wherein the pixel extraction circuit is to define each output frame so that if the pixels in each row of a frame were numbered 1,2,3, . . . , one half of the odd numbered pixels in each output frame are old pixels and one half are new pixels.

13. The article of manufacture of claim 8 wherein the pixel extraction circuit and the timing circuit are to detect that each input group has essentially one-half the number of pixels as an output frame.

14. The article of manufacture of claim 8 further comprising:

a digital to analog converter coupled to the output of the pixel multiplexer to convert the sequence of output frames into analog form.

15. A method comprising:

receiving a sequence of input groups, each input group containing a plurality of input pixels; and providing a sequence of output frames, each output frame containing a plurality of output pixels to refresh a display screen, wherein the pixels of each output frame include (1) a plurality of new pixels which are the input pixels of a respective input group, and (2) a plurality of old pixels which are the input pixels of a previous input group, the previous input group being an input group that is received previous to the respective input group, wherein the receiving and providing operations are performed in a graphics component of a chipset, the sequence of input groups being received through a main memory interface of the chipset.

16. The method of claim 15 wherein the previous input group is the input group that is received immediately prior to receiving the respective input group.

17. The method of claim 15 wherein the pixels of each output frame essentially consist of the plurality of new and old pixels.

18. The method of claim 17 wherein each input group has essentially one-half the number of pixels as an output frame.

19. The method of claim 18 wherein the sequence of input groups is received at a rate that is sufficiently high so as to allow the display screen to be refreshed at over 100 Hz.

20. The method of claim 17 wherein, if the pixels in each row of a frame were numbered 1,2,3, . . . , one half of the odd numbered pixels in each output frame are old pixels and one half are new pixels.

21. The method of claim 16 further comprising:

converting the sequence of output frames into analog form to drive one or more guns of a cathode ray tube (CRT) in the display monitor.

* * * * *